US005428862A

United States Patent [19]

Sailer

[11] Patent Number: 5,428,862

[45] Date of Patent: Jul. 4, 1995

[54] INDUCT CLEANING APPARATUS WITH SEALING MEMBER

[76] Inventor: Johann Sailer, An der Sandhühl 8, 89335 Deubach, Germany

[21] Appl. No.: 109,740

[22] Filed: Aug. 20, 1993

[30] Foreign Application Priority Data

Sep. 18, 1992 [DE] Germany ..... 42 31 283.3
Mar. 20, 1993 [DE] Germany ..... 43 09 026.5

[51] Int. Cl.[6] ..... A47L 7/02

[52] U.S. Cl. ..... 15/321; 15/304; 15/387

[58] Field of Search ..... 15/304, 104.12, 104.31, 15/321, 345, 383, 387; 134/167 C, 168 C

[56] References Cited

U.S. PATENT DOCUMENTS 3,106,735 10/1963 Landrum ..... 15/104.12
3,446,666 5/1969 Bodine ..... 134/167 C
3,890,905 6/1975 Clavin ..... 15/140.12
4,027,349 6/1977 Clavin ..... 15/104.12
4,473,921 10/1984 Weber ..... 15/304
4,622,709 11/1986 Matsuda ..... 15/140.31
5,109,567 5/1992 Harrison ..... 15/345

FOREIGN PATENT DOCUMENTS 961804 9/1982 U.S.S.R. ..... 15/104.12
1202638 1/1986 U.S.S.R. ..... 15/104.12

*Primary Examiner*—David A. Scherbel
*Assistant Examiner*—Terrence R. Till
*Attorney, Agent, or Firm*—Harrison & Egbert

[57] ABSTRACT

An appliance adapted to be introduced into the interior of a pipe comprises a suction head arranged at the end of a flexible hose for suction air, which at the end adjacent to the hose has suction openings connected with the hose, carries a plurality of support wheels arranged in two planes perpendicular to the direction of insertion, and extending in a radial direction past the suction head, and is provided with a seal which is biased resiliently in a radially outward direction and is arranged between the suction openings and the hose.

38 Claims, 11 Drawing Sheets

INDUCT CLEANING APPARATUS WITH SEALING MEMBER

BACKGROUND OF THE INVENTION

The invention relates to an appliance adapted to be run along the interior of a pipe.

More particularly in the case of power stations, in the chemical industry and in the petroleum industry there is the aim of being able to perform operations in the interior of pipes.

SHORT SUMMARY OF THE INVENTION

One object of the invention is to provide an appliance of the type initially mentioned which is simple in design and is reliable in operation, may be run on readily available sources of power and may furthermore be utilized in pipe with a multiplicity of elbows arranged in close succession.

In accordance with the invention this object is to be achieved with an arrangement comprising a suction head arranged at the end of a flexible hose for suction air and which possesses suction air openings connected with the hose and furthermore a plurality of support wheels arranged in two planes extending perpendicularly to the direction of insertion of the appliance into the pipe, which wheels project past the suction head in a radial direction and is provided with a radially outwardly movable resilient seal arranged between the suction air openings and the hose.

When such an appliance is introduced into a pipe of which one end is shut off, the suction head will be moved by the pressure difference between the low pressure zone produced in front of it and the higher pressure zone obtaining behind it in the pipe. The suction air employed for moving the suction head is available practically everywhere. In this form the appliance is able to be employed for removing dirt from the pipe in the form of particles, because the same are aspirated as by a domestic vacuum cleaner, owing to the pressure difference, through the suction openings and into the hose. Thus it is possible, for example, to remove fine dust which results when a pipe is produced by welding together separate pipe sections, and grinding down the welds. The appliance in accordance with the invention may however be designed in a large number of different forms for further applications.

Preferably on the side, which is in front in the direction of travel, of the suction head bears at least one venting cover, the or each such venting cover shuts off a space which is connected with the pipe behind the seal and is able to be adjusted for forming a gap between it and the pipe in front of the seal. By increasing the size of the gap it is possible to reduce the pressure difference between the spaces in front of and behind the suction head and consequently it is possible to modify the forward thrust of the suction head. Furthermore on opening the venting cover the inner surface of the pipe is scavenged by blowing, something which enhances the cleaning action.

It is an advantage if for automatic opening of the gap and adjustment of the gap size a setting spring is provided which acts when a predetermined difference in the pressure in front of the seal and behind the seal in the pipe is exceeded. With this arrangement the venting cover is always so adjusted that a predetermined pressure difference is maintained.

in accordance with a further advantageous development of the invention a control member is provided for axial movement of the venting cover independently of the setting spring. This means that not only the forward thrust force and with it the speed of forward motion may be reduced at certain points, but furthermore the suction head may be arrested.

Preferably the venting cover is in addition rotatably mounted in relation to the suction head and is furthermore provided with a drive and connecting means for tools. The venting cover may therefore additionally directly utilized a means for carrying tools.

It is more especially an advantage if on the side facing the front part of the suction head the venting cover is provided with vanes in order to constitute a drive impeller. In the case of this design the pressure upstream and downstream from the suction head is employed for driving the tools.

It is convenient for the support wheels to be adapted for adjustment in the radial direction. This renders possible an adaptation to suit various different pipe bore diameters. In this respect it is to be taken into account that in the case of a pipeline made up of pipes with a rated bore diameter there will be a reduction in the effective bore diameter in bends. In order always to achieve an engagement of all support wheels on bore surface the wheels are best arranged to be acted upon by springs urging the same outwards.

An other advantageous feature of the invention is such that the suction head comprises a front part bearing the venting cover and a rear part bearing the front support wheels, which parts are detachably connected together; on the rear part it is possible for a hose connection port or nipple to be provided and the rear support wheels may be mounted. This design renders possible an introduction of the suction head through extremely small openings in the pipe in individual sections thereof.

In accordance with a further advantageous development an annular support for a retrieving device is able to be mounted on the suction head, said retrieving device bearing a ring of resilient blades whose outwardly angled outer edges engage the pipe bore surface in the working state and by means of a cord are able to be held in a bell-shaped configuration clear of the bore surface in an introduction setting thereof. With such a design it is possible for parts which have fallen into the pipe to be pulled as far as an opening in the pipe, from which they may then be withdrawn by hand.

An other advantageous feature is such that centered on the longitudinal center axis of the suction head there is a central plug connection for the attachment of tools. An inspection device, for example in the form of a video camera, may then be joined with this plug connection. This not only creates the possibility of inspecting the pipe from the inside but furthermore it is possible to monitor the course of an operation being performed on the pipe, for example a grinding operation.

The invention furthermore contemplates an arrangement in which on a rotatable part of the suction head a liquid applying device can be connected, which possesses at least one liquid container and a compressed air container. In this respect the or each liquid container contains a collapsible bag, whose outer side is able to be acted upon by pressure from the compressed air container. This means that a testing operation may be performed to detect any cracks in the pipe which would make necessary the application of liquids to the bore surface.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
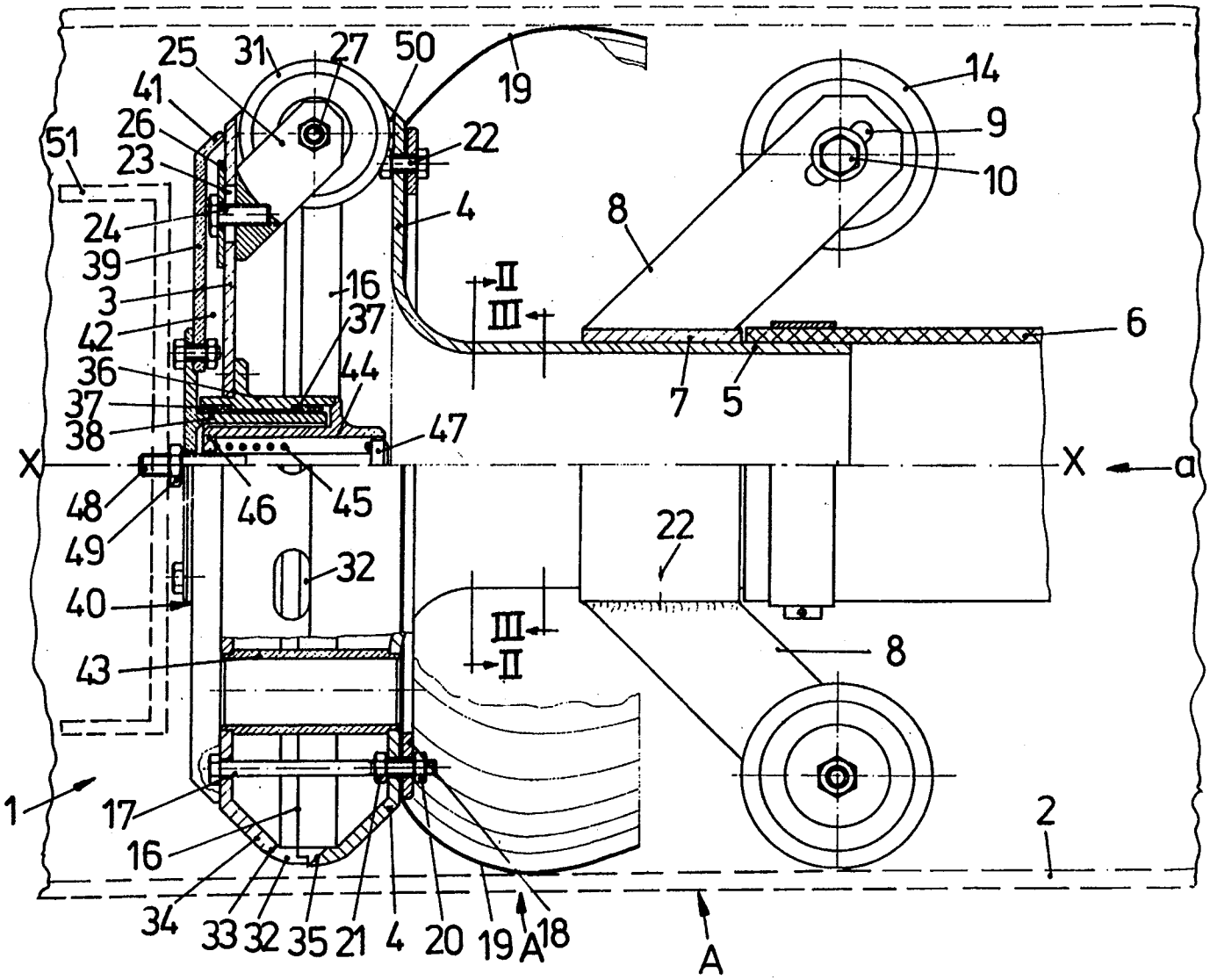
FIG. 1 shows a longitudinal taken through a suction head.
Figure 2:
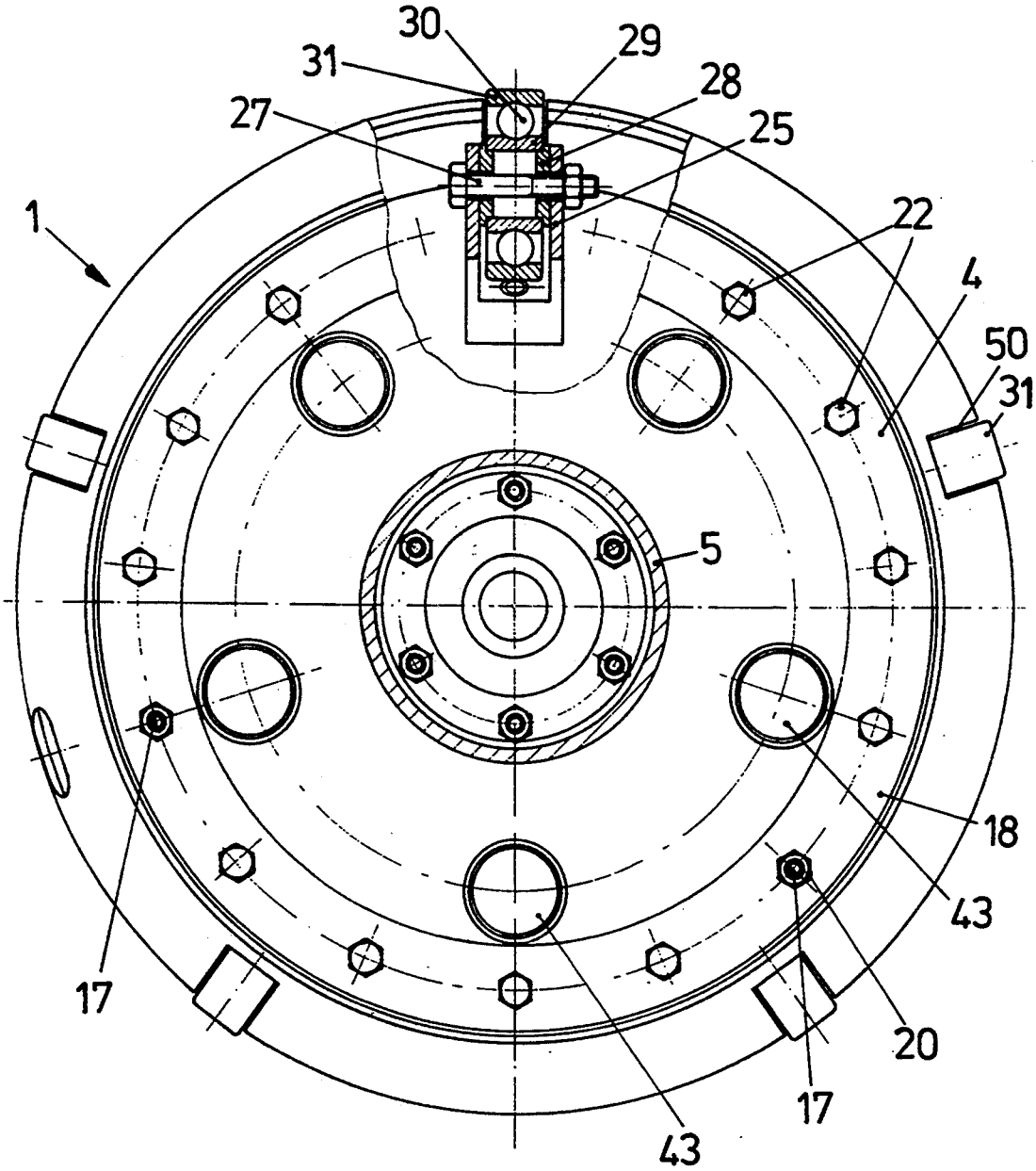
FIG. 2 is a section taken on the line II—II of FIG. 1 after removal of the seal.
Figure 3:
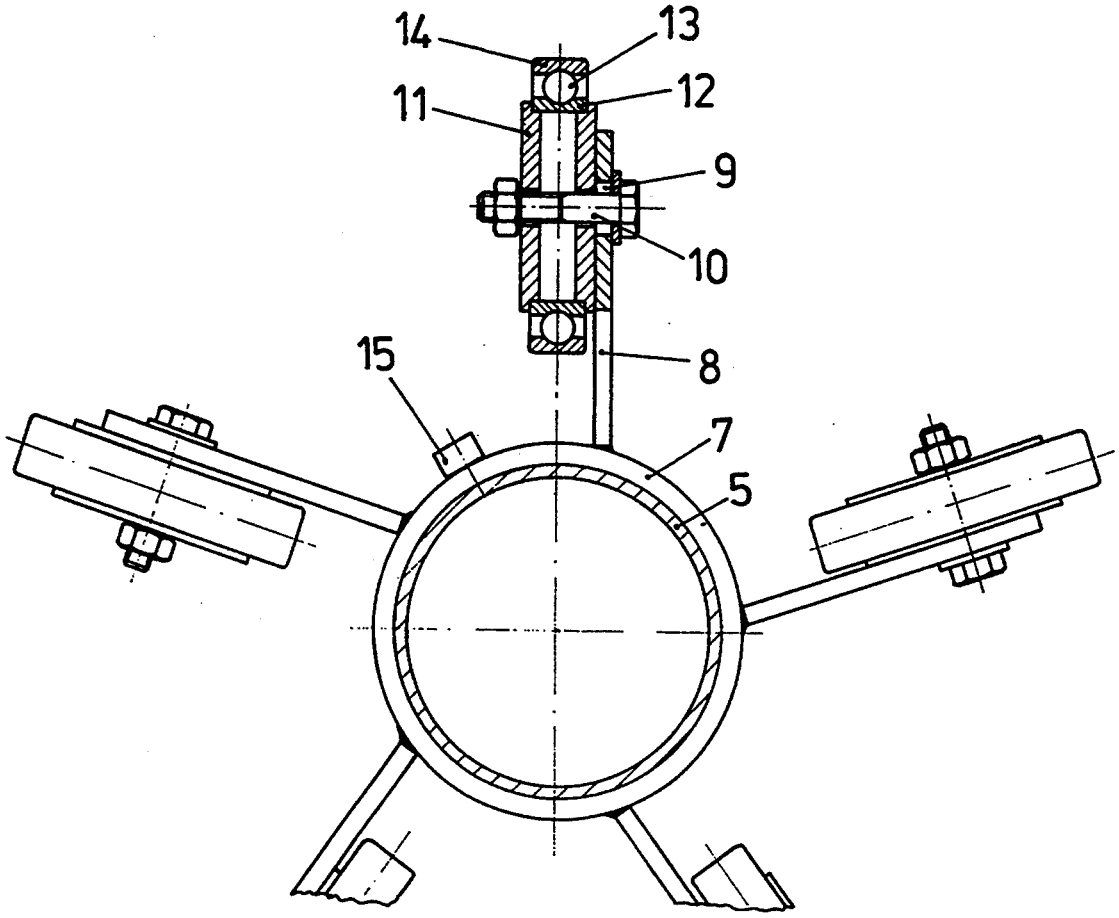
FIG. 3 is a section taken on the line III—III of FIG. 1.

The appliance depicted in FIGS. 1 through 4 comprises a suction head generally referenced 1, which is adapted to travel along and within a pipe 2 shown in broken lines. The suction head 1 possesses a shell-like front part 3 and rear part 4, which is also shell-like. The rear part 4 ends in a connection nipple 5. On the connection nipple 5 a flexible air-tight hose 6 is attached. The hose 6 leads to a vacuum producing means, for instance in the form of an impeller fan, which may be preceded by a filter.

A bushing 7 is mounted in a sliding fashion on the connection nipple 5 and it has a plurality of support lugs 8, preferably three or better still five of them, which extend approximately in a radial direction. Adjacent to its outer end each support lug 8 has an adjustment slot 9. Through each adjustment slot 9 there extends a set screw 10 with a nut, with which a support bushing 11 may be set on the support lug 8. The support bushing 11 is fixedly connected with the inner race ring 12 of a ball bearing 13, whose outer race ring constitutes a support wheel 14. After slackening off the set screw 10 the latter may be slid along the adjustment slot 9. As a result the support wheel 14 is set in a radial direction. By sliding the bushing 7 along the connection nipple 5 there is furthermore an adjustment of the support wheel 14 in the axial direction, that is to say in the direction of the central longitudinal axis X—X of the suction head 1. The bushing 7 is then secured by a holding screw 15, acting on the connection nipple 5, in its setting.

The front part 3 and the rear part 4 are clamped together along their joint 16 by means of a plurality of holding screws 17. The holding screws 17 extend together through an outer ring 18, arranged behind the rear part 4, with which the angled ends of a plurality of vane-like, resilient sealing elements 19 are held between the ring 18 and the rear part 4. The sealing elements 19 constitute a seal, which prevents equalization of pressure between the vacuum in the space in front of the suction head 1 and the external pressure behind the suction head. In this respect it is convenient if the heads of the holding screws 17 engage the outer side of the front part 3, while the clamping force is applied by means of nuts 20. In addition to this lock nuts 21 are provided on the inner side of the rear part 4. In order to thrust the ring as far as possible along its full periphery evenly against the angled ends of the sealing elements 19, there is in addition a series of further short holding screws 22 with nuts, which only extend through the ring 18 and the rear wall of the rear part 4.

Figure 4:
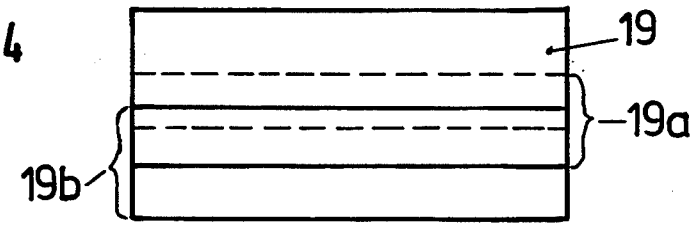
FIG. 4 is a elevation of part of the seal looking in the direction of the arrow A in FIG. 1.

The sealing elements 19, 19*a* and 19*b*, which in the embodiment of the invention consist of resilient sheet metal, overlap, as illustrated in FIG. 4, partially. They are furthermore, as depicted in FIG. 1 as well, bent convexly towards the bore surface of the pipe so that they are in engagement with a central part of the bore surface of the pipe 2. Owing to this design it is possible for them to allow for changes in the inner diameter of the pipe, for instance on passing through bends, without the sealing effect being overridden or impaired. Furthermore the resilient sheet metal parts are thrust against the inner surface of the pipe by the pressure difference.

In the front part 3 there are several adjustment slots 23 extending in the radial direction. A respective set screw 24 extends through each adjustment slot 23 and using the screw it is possible to set a bearer 25 on the front part 3. In this respect each adjustment slot 23 is additionally covered over by a cover disk 26 so that it is not possible for there to be an equalization of pressure through the adjustment slot 23. A holding screw 27 with a nut extends through each bearer 25, with which a support bushing 28 may be set in position on the bearer 25. Each support bushing 28 holds the inner race ring 29 of a ball bearing 30, whose outer race ring constitutes a support wheel 31. In this respect the arrangement is so designed that each support wheel 21 only extends a slight extent past the outer- periphery of the suction head 1 through a slot 50, whereas the other support wheel and the bearer 25 are accommodated in the interior of it. After slackening off the set screw 24 it is possible for the bearer 25 with the support wheel 31 to be set in a radial direction. The radial ranges of adjustment of the support wheels 14 and 31 are so designed that when they are moved out to the maximum extent they are on a diameter which is smaller than the diameter, which is defined by the outwardly bent central parts of the sealing elements 19, when suction the head 1 is not in a pipe. Moreover the two planes extending perpendicularly to the direction a of insertion, in which the support wheels 14 and 31 are arranged, are preferably so arranged that the sealing elements 19 are between them.

Between the support wheels 31 a plurality of suction air openings 32 are provided in the suction head 1, which are connected with the connection nipple 5. The suction air openings 32 in this respect, as depicted in FIG. 1, arranged in the outer part of the suction head 1. Their front limiting surface 33 is located in a wall part 34, which in a direction opposite to the direction a of insertion extends obliquely in relation to the inner bore wall of the pipe 2, of the front part 3. In this respect the front limiting surface 33 of each suction air opening 32 ends on a smaller diameter than the rear limiting surface 35, which in the embodiment of the invention is provided on the rear part 4. The rear limiting surface 35 extends obliquely with respect to the insertion direction a towards the inner bore surface of the pipe 2. It hence constitutes a knife edge running directly over the inner bore surface. Owing to this design there is at each suction air opening 32 a powerful suction current directed into the interior of the suction head 1 which aids in the drawing off of dirt particles from the bore surface. The sum of the cross sectional areas of the suction openings is at the most to be equal to the cross sectional areas of the connection nipple in order to achieve a sufficient suction effect into the suction openings.

In order to adjust the pressure difference between points in front of and behind the suction head 1 the front part has a round recess, centered on the central alignment axis X—X of the suction head 1, in which a bushing holder 36 is set. On the bushing holder 36 a two-part bushing 37 is attached, in which a guide sleeve 38 is mounted so that it may be slid in translation. The guide sleeve 39 constitutes, together with an annular part 39, a venting cover generally referenced 40 and arranged in front of the end of the front part 3, whose angled edge 41 may engage the front part 3. The front part 3 and the venting cover 40 define an annular space 42, which is connected via a plurality of tube members 43 with the outside atmosphere behind the suction head 1.

On the bushing holder 36 a bushing 44 is also attached, in which a setting spring 45 in the form of a compression spring is arranged. The setting spring 45 has one end bearing against a flange 46 on the bushing 44 and the other end against a foot piece 47 of a screw threaded pin 48. The screw threaded pin 48 extends through the venting cover 40 and on the outer side of the venting cover bears an adjustment nut 49. By turning the adjustment nut 49 it is consequently possible to set the force of the setting spring 45. If an extremely high pressure builds up in operation in front of the suction head 1, the suction head 1 will move with a relatively high thrust in the direction a of insertion. If now the thrust is to be reduced, then by moving the angled edge 41 of the venting cover 40 clear of the front part 3 it is possible for atmospheric air to move into the space in front of the suction head 1 so that the vacuum and therefore the thrust will be reduced. Since the vacuum in front of the venting cover 40 will tend to move the same in the direction a of insertion away from the front part, it is possible by adjustment of the force of the setting spring 45, which opposes such clearing motion, to make an adjustment which, when a certain vacuum is exceeded, automatically allows a supply of air and consequently a reduction of the vacuum. However instead of a central venting cover it is possible furthermore to have a plurality of venting covers, for instance one for each tube member 43. Furthermore it would be possible to dispense with the setting spring 45, if the venting cover or covers are able to be set by hand in order to form one or more gaps with a constant size.

If the arrangement is to be employed for inspecting the bore surface of pipe 2, it is for example possible to mount a holder 51, as shown in broken lines, on the screw threaded pin 48 for an inspecting device, as for instance a camera. As a matter of principle such a holder might however be connected at other points of the suction head as well.

Prior to the introduction of the suction head 1 into a pipe on the one hand the force of the setting spring 45 is set at the desired level by turning the adjustment nut 49. On the other hand the support wheels 14 and 41 are reset to the minimum pipe diameter to be expected. In this respect the suction head 1 is, in straight sections of the pipe, only supported by some of the support wheels 14 and 31 present, as shown in FIG. 1. The cleaning action is not affected by this, since the particles to be removed collect preferentially on the lower part of the bore surface. Normally the axial distance between the support wheels 14 on the one hand and the support wheels 31 on the other hand is to be approximately equal to the diameter of the outer sides of the support wheels 14 and 31. In the case of a pipe with sharp bends it may be an advantage to reduce this distance by offsetting the support wheels. After introduction of the suction head 1 into a pipe no further adjustments are called for.

Figure 5:
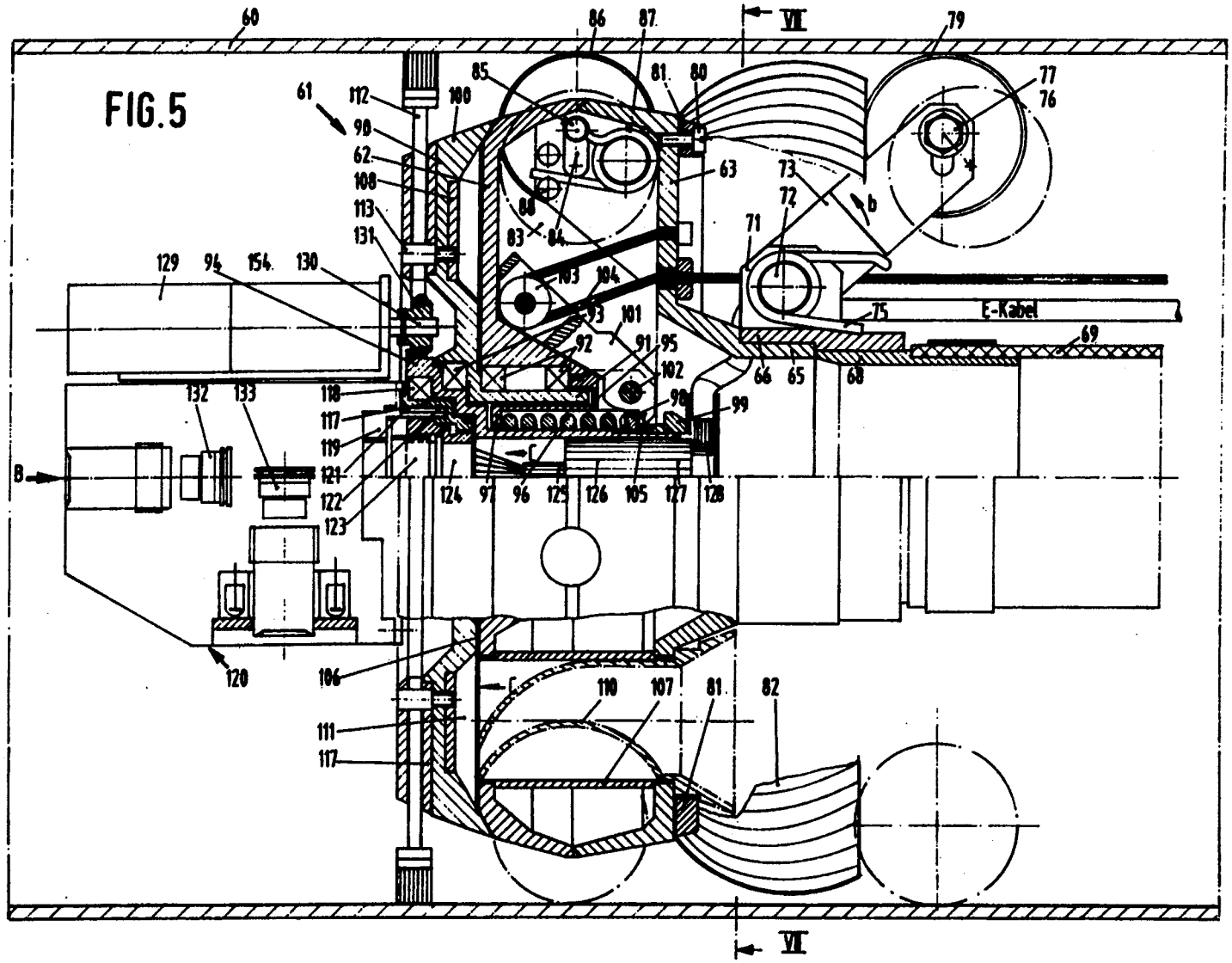
FIG. 5 shows a second embodiment of the invention in a view corresponding to FIG. 1.

The embodiment of the invention illustrated in FIG. 5 possesses a suction head generally referenced 61 able to be introduced into a pipe 60. The suction head 61 has a shell-like front part 62 and a rear part 63, which is also shell-like, said parts being connected detachably together by screws 64. The rear part 63 ends as a connection nipple 65, on whose outer periphery a bushing 66 may be slipped and fixed in position by means of a spring-loaded detente pin 67. In a section with a smaller diameter of the bushing 66 a connection nipple 68 may be introduced, which is permanently connected with a hose 69. The bushing 66 is in this respect able to be connected with the connection) nipple by means of a further detente pin 70.

On its outer periphery the bushing 66 bears a plurality of bearers 71. In each bearer 71 a support lug 73 is pivotally mounted by means of a pin 72. Around the parts outside the bearer 74, of the pin 72 a spring 74 is wound, of which both free ends 75 bear against the bushing 66, whereas the central part 76 of the spring 74 bears against support lug 73 and pivotally urges the same in the direction of the arrow b about the pin 72. An adjustment slot 76 is provided in the free end of the support lug 73. A set screw 77 extends through each adjustment slot 76, so that using the screw a support bushing 78 may be secured to the support lug as in the first embodiment of the invention. The support bushing 78 is fixedly connected with the inner race ring of a ball bearing (not illustrated), whose outer ring constitutes a support wheel 79.

As in the first embodiment of the invention on slackening off the set screw 77 it is possible to adjust the support wheel 79 in a radial direction. This adjustment is conveniently performed to set the same at the maximum bore diameter of the pipe 60. Since however the support wheel 79 is acted upon by the spring 74, it may get past a narrow part of the pipe by pivoting against the direction of the arrow b. This measure ensures that at all times all support wheels 79 are in resilient engagement with the bore surface of the pipe 60. The support lug 73 may be provided with abutment surfaces 73*a* and 73*b*, which limit pivotal movement of the support lug in the direction of the arrow b and in the opposite direction.

A ring 81 is screwed to the rear part 63 by means of screws 80, said ring holding the angled ends of a plurality of vane-like, resilient sealing elements 82 between the ring 81 and the rear part 63. The sealing elements 82 for their part constitutes a seal, which prevents pressure equalization between the low pressure space in front of the suction head 61 and the higher pressure space behind the suction head 61. The sealing elements 82 are designed and arranged just like those employed in the first embodiment of the invention.

On the rear part 63 a plurality of bearers 83 is also secured, which are provided with longitudinal slots 84. Through the two longitudinal slots of each bearer 83 there extends a pin 85, on which a support wheel 86 is rotatably bearinged. On either side of the bearer 83 there is a respective coiled spring 87, whose one end bears against a pin 88 of the bearer 83 and whose other end extends through a hole in the pin 85. The springs 87 in this case urge the pin 85 against the outer end of the longitudinal slot 84. In this position the support wheels 86 are moved fully out of the suction head 61. If necessary it is possible for the bearers to be secured additionally in the radial direction in an adjustable fashion on the rear part 63. Between the support wheels 86 a plurality of suction air openings 89 are arranged in the suction head 61, which openings are directly connected with the connection nipple 65.

In front of the outer side of the front part 62 an annular venting cover 90 is arranged, which has a guide sleeve 91 with which it is supported by means of two bearings 92 in relation to the front part. The bearings 92 are so designed that they allow both rotary movement of the venting cover as well an axial displacement of the cover in relation to the front part 62. The venting cover 90 is supported by means of a further bearing 93, which only permits rotary motion, in relation to a support bushing 94. The rotary support system for the venting cover 90 renders it possible for it to be utilized as a support for rotary tools.

On the front part 62 a spring bushing 95 is furthermore secured, in which a setting spring 96, designed in the form of a compression spring is arranged. The setting spring 96 has one end thereof bearing against a flange 97, which is fixedly joined to the front part 62. The other end of the setting spring 96 is in engagement with an abutment ring 98, which is screwed on the support bushing 94. Using the screwed on abutment ring 98 it is possible for the length of the setting spring 96 to be changed in the non-working position and therefore the spring force may be modified. Just as was the case with the first working embodiment this involves an automatic limitation of the maximum permissible pressure difference between the spaces in front of and behind the suction head 61. If there is an increase in the pressure difference past this predeterminable amount, the closing force of the setting spring 96 is overcome and the edge 100 of the venting cover 90 will come clear of the front part 62.

In order to additionally reduce the forward speed of the suction head 61 or to arrest it or to move back the suction head 61 at a particular position, a two-armed control lever 101 is provided. This control lever 101 is able to be pivoted about a fixed pin 102. At one end of the control lever 101 a rope pulley 103 is rotatably bearinged. About the pulley 103 a cord 104 is trained, whose one end is secured to the rear part 63. The other end of the cord 104 is run to the rear as far as the opening in the pipe 60, through which the suction head has been introduced into the pipe. The other end of the lever 101 is provided with a ramp surface 105, which may be guided against the abutment ring 98 in order to move the same in the direction of the arrow c. This movement is transmitted directly via the support bushing 94 and the bearing 93 to the venting cover 90.

In order to connect the space 106 between the front part 62 and the venting cover 90 a plurality of tube members 107 are provided extending through the suction head 61 in the axial direction. Using such tubes it is hence possible to produce a partial or complete pressure equalization by the spaces in front of and behind the suction head 61.

Figure 6:
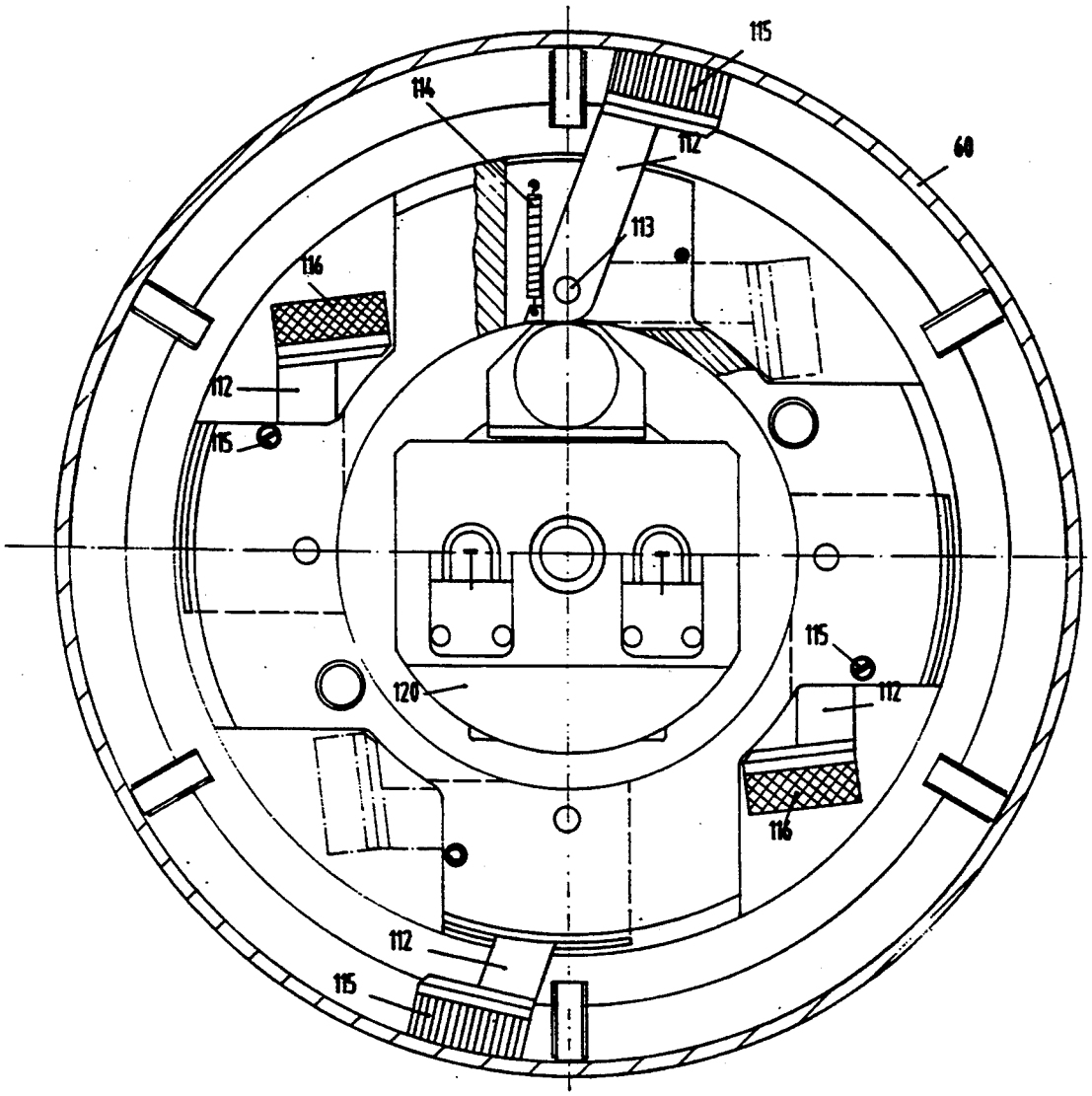
FIG. 6 is a view looking in the direction of the arrow B in FIG. 5.
Figure 7:
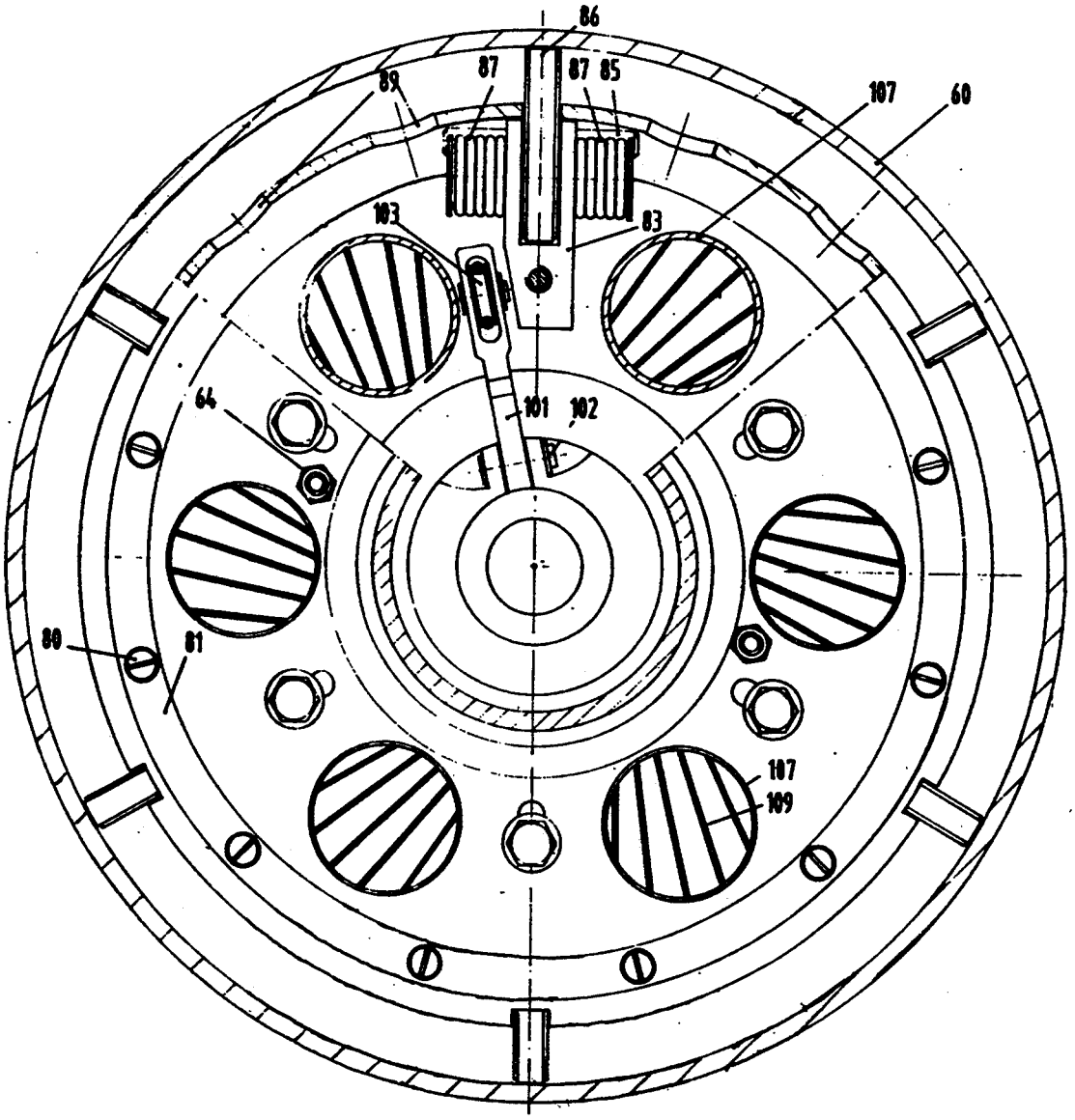
FIG. 7 shows a section taken on the line VII—VII of FIG. 5 partly broken away and after removal of the seal.
Figure 9:
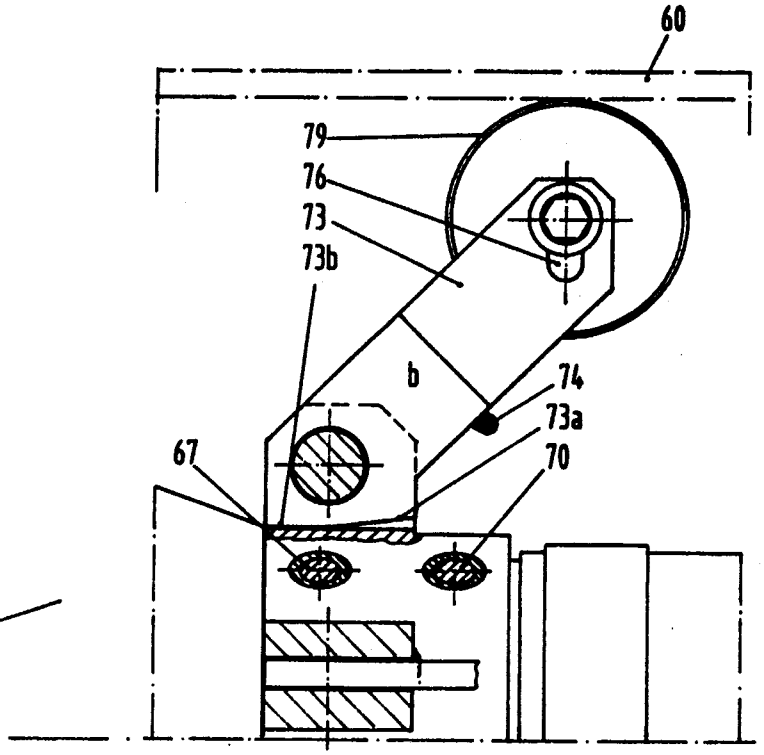
FIG. 9 shows the arrangement in accordance with FIG. 8 from the side.
Figure 8:
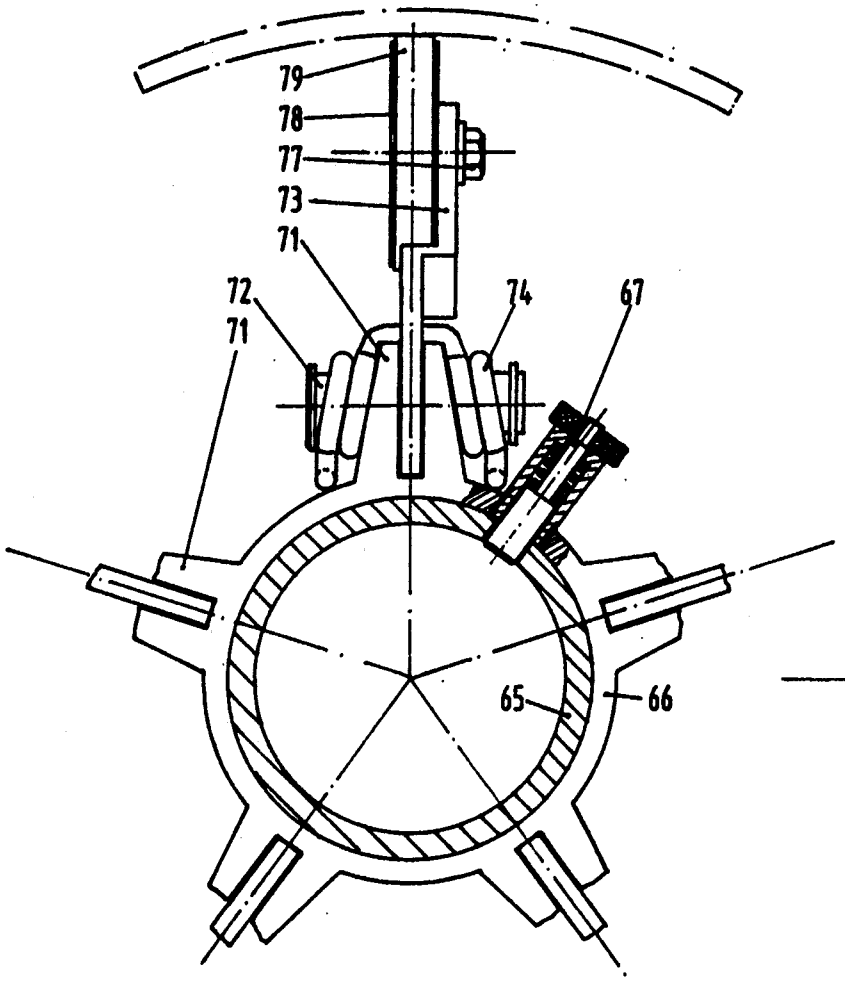
FIG. 8 shows the bearing arrangement for the rear wheels as seen looking in the direction of the longitudinal central axis of the suction head.
Figure 10:
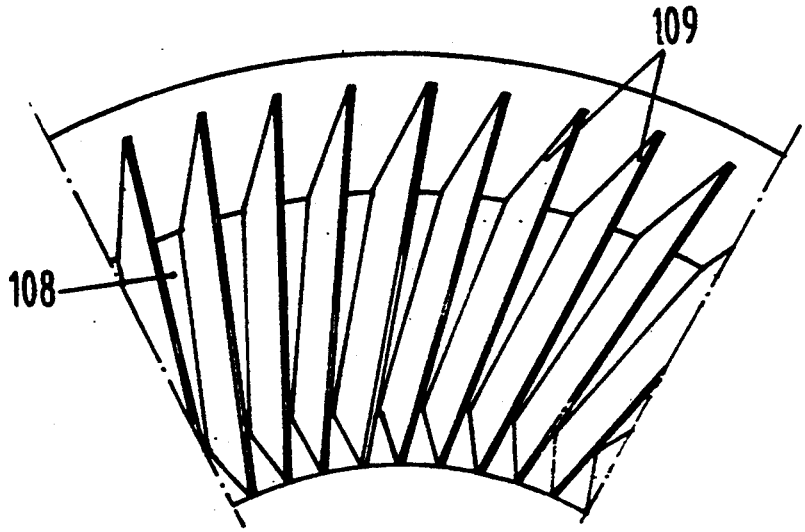
FIG. 10 is a view of part of the vanes looking in the direction of the arrow C in FIG. 5.
Figure 13:
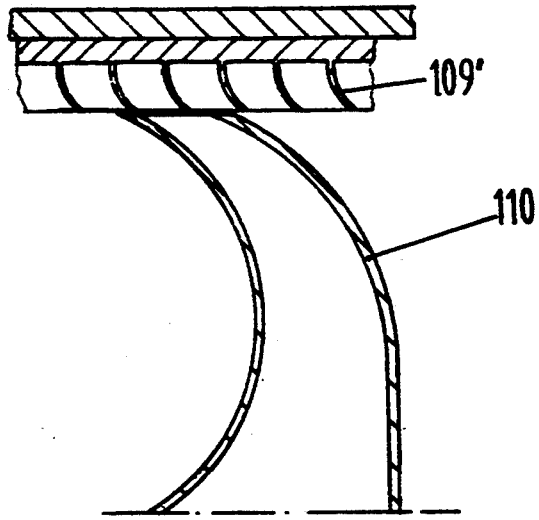
FIG. 13 shows a modification of the vanes in a diagrammatic sectional elevation.
Figure 12:
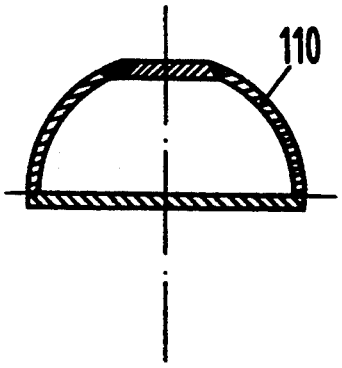
FIG. 12 is a section on the line XII—XII of FIG. 11.
Figure 11:
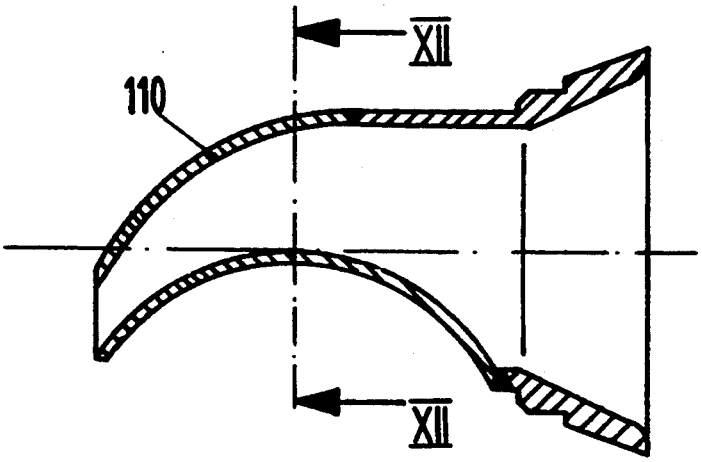
FIG. 11 is longitudinal section of a nozzle.
Figure 14:
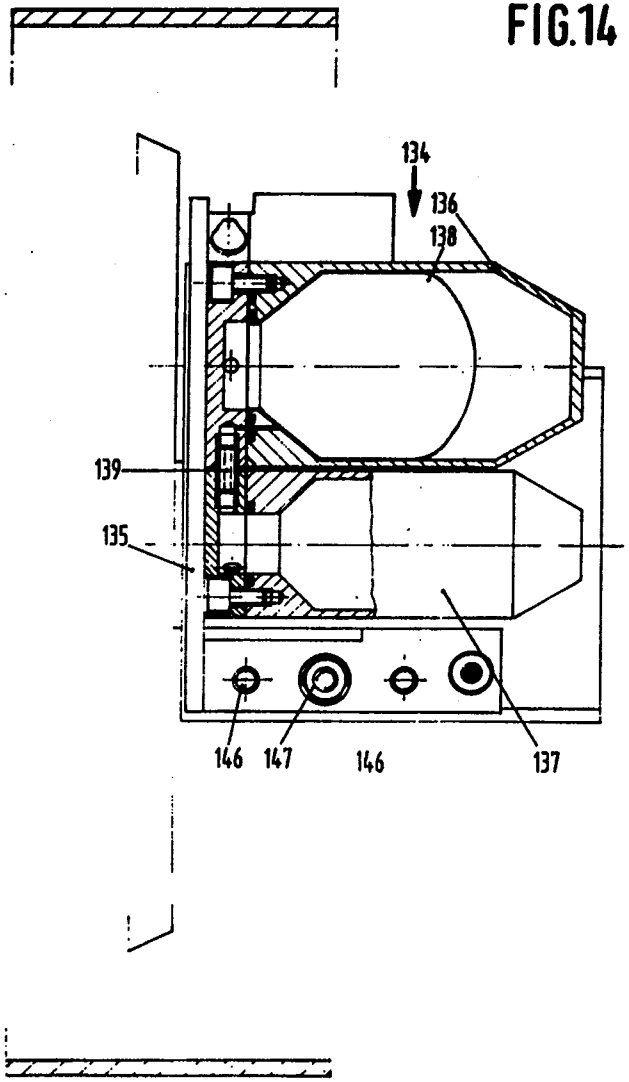
FIG. 14 shows the liquid application device in a longitudinal section.

On the side, facing the front part 62, of the venting cover 90 a support ring 108 is permanently joined. The support ring 108 has a space 111 accommodating vanes 109 which constitute a drive impeller. Owing to this feature it is possible, after opening the venting cover 90 to utilize the resulting air current to get a drive movement turning the venting cover 90. In order to improve the efficiency nozzles 110 may be inserted into the tube members 107. These nozzles at the one end have cross section becoming narrower towards the vanes 109 and at the other end are so bent that blowing onto the vanes 109 is possible. In FIG. 6 the nozzle 110 as shown in broken lines is illustrated in a position turned through 90° in relation to its actual position. For further improvement of efficiency it is possible furthermore to employ vanes 109', which are curved as shown in FIG. 13. As a rule however flat vanes which, may be simply produced are satisfactory, which are only set obliquely against the direction of flow thereinto.

Tools may be directly connected with such a venting cover 90 designed in the form of a drive impeller, which may be then be caused to rotate by a larger or smaller opening of the gap between the edge 100 and the front part 62. For this purpose in the embodiment of the invention a plurality of support levers 112 are present, which are best connected about axes 113 parallel the center axis in a replaceable fashion with the venting cover 90. Each support lever 112 is furthermore acted upon by the action of a return spring 114, which tends to hold it in a neutral position within the lines surrounding the suction head. In this neutral it is possible, as is shown for the support lever 112', for the same to be maintained in position by locking screws or pins 115 so that the support levers 112' do not pivot out of position even on rotation of the venting cover 90. In the illustrated working embodiment of the invention on the two support levers 112 wine brushes 115 are arranged for cleaning the inner wall surfaces of the pipe 60. On rotation of the venting cover 90 the support levers 112 swing under the action of centrifugal force towards the inner bore surface of the pipe 60. Owing to the engagement of the wire brushes 115 on the inner bore surface of the pipe 60 there is a simultaneous braking force. By selecting a suitable size of the return springs 114 and of the weights of the support levers 112 with their tools it is possible to achieve the desired speed of rotation of the venting cover 90. In the illustrated working embodiment of the invention grinding heads 116 are furthermore mounted on the support levers 112', which may be alternatively employed. It is naturally possible furthermore for all support lever to be furnished with grinding heads or with wire brushes.

In the illustrated working embodiment of the invention a plug connection is furthermore provided centered on the longitudinal center axis of the suction head 61 for the connection of further tools. The plug connection comprises a coupling ring 117 having a bearing 118 enabling it to be rotated which being connected with the support bushing 94 with axial displacement being possible. Between the two limbs of the coupling ring with a U-like cross section it is possible for a connection sleeve 199 of an inspecting device 120 to be inserted. In order to render possible a fitting together of the parts of the plug connection at only one predetermined position the coupling ring 117 bears a key pin 121, which has to be introduced into a groove 122 in the connection sleeve 119. In the interior of the coupling ring 117 there is furthermore an inherently known plug contact arrangement 123 (not illustrated in detail) comprising plug-in pins and sockets. The part 124 connected coupling ring 117 of the plug contact arrangement 123 is furthermore fixedly joined with the inner bushing 125 of a slip ring contact arrangement 126, whose outer bushing 127 is fixedly connected with the support bushing 94. From the outer bushing 127 the conducting wires 128 run to the opening in the pipe 60, through which the suction head has been inserted in the pipe 61. The inspection device 120 may consequently be turned, without interruption in the electrical leads, in relation to the support bushing 94. For rotation of the inspection device there is a drive motor 129, preferably in the form of a geared electric motor, which renders possible a slow rotation of the inspection device. The drive motor 129 possesses a drive shaft 130, on which a drive wheel 131 is mounted. The drive wheel 131 can roll on the outer side of the support bushing 94. It is convenient for the drive wheel 131 to be in the form of a friction wheel. When the drive wheel 131 runs on the outer surface of the support bushing 94, it will then slowly turn the inspection device 120 together with the coupling ring 117 and the bushing 125 of the slip ring contact arrangement 126 about the longitudinal center axis of the suction head 61. In order to prevent unintended release of the plug connection 117 and 119, the outer side of the support bushing 94 has a rib 154 provided on it which extends over 360°. The rib 154 fits behind the drive wheel 131 in the working position thereof and consequently locks entire inspection device 120, possibly together with the liquid application device 134, in the pull off direction. In order to produce this locking action after plugging on the inspection device the motor is urged by a screw against a spring force in the direction of the longitudinal center axis of the suction head and the friction wheel is therefore brought into engagement.

In the illustrated working embodiment of the invention the inspection device 120 is a video camera with a source of light. It furthermore has two objectives 132 and 133, of which the objective 132 is directed along the center longitudinal axis of the suction head 61 and the objective 133 is directed towards the inner wall surface of the pipe 60.

Figure 15:
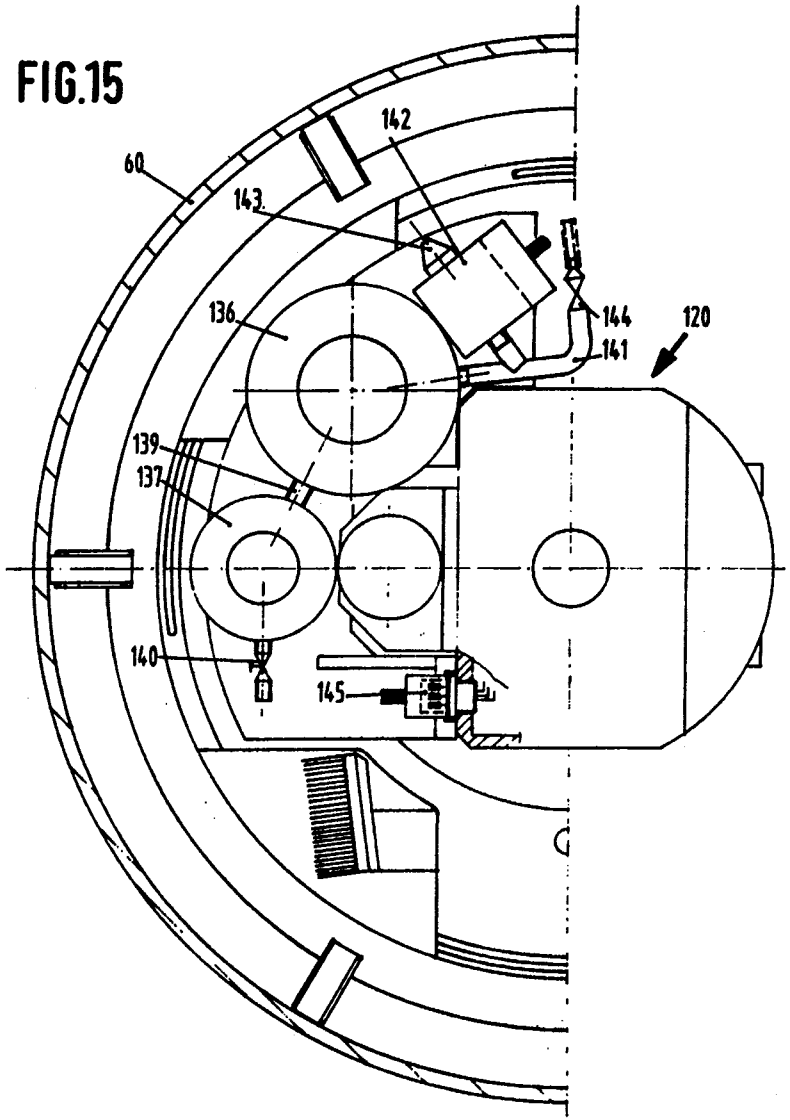
FIG. 15 shows the arrangement in accordance with FIG. 14 in a partial front end-on view.

It is furthermore possible for a liquid application device, which is generally referenced 134, to be connected with a rotatable part of the suction head 61. In the present working embodiment of the invention the liquid application device 134, as illustrated in FIGS. 1, 4 and 15, is mounted by means of a support frame 135 on the inspection device 120. The illustrated liquid application device 134 has a liquid container 136 and a compressed air container 137. In the liquid container 136 there is a bag 138, able to be filled with the liquid, of a flexible material. The outer side of the bag 138 is connected via a connection line 139 with the interior of the compressed air container 137. For filling the compressed air container with compressed air there is a shut off valve 140 with a nipple for connection with a compressed air hose. From the liquid receiving space in the liquid container 136 there extends a line, which runs on the one hand to a solenoid valve 142 with a following spray nozzle 143 pointing towards the bore surface of the pipe 60. A further branch of the line 141 leads to a check valve 144 follow which there is in turn a connection nipple for filling the bag 138 in the liquid container 136 with liquid. The liquid application device 134 is able to be connected by means of a plug contact device 145 with the electricity supply for the inspection device 120 and for mechanical connection there are two locating pins 146 on the support arm 135 and furthermore an attachment screw 147.

For filling the liquid application device 134 with a liquid the first step is to open the shut off valve 140. As a result the compressed air container 134 is vented. Then via the check valve 144 and the line 141 the bag 138 in the interior of the liquid container 136 is filled up with liquid and then via the open shut off valve 140 compressed air is introduced into the compressed air container 137. After this the shut off valve 140 is closed. When the device has been introduced into the pipe 60 and is at the position at which liquid is to be applied to the bore surface 60, the solenoid valve 142 is opened. Simultaneously the inspection device 120 is rotated by means of the electric motor 129. It is now possible for the liquid to be applied to an annular section of the surface of the pipe 60, for example a weld seam.

If the liquid application device is to be utilized for performing a dye penetration test, it is convenient to use a liquid application device which has three liquid containers, which are designed like the liquid container 136. For this testing operation three liquids are to be applied to the area to be tested. Thus since three liquid containers are employed in this case, there is no need to remove from the pipe section the entire suction head 61 after the application of one liquid in order to be able to charge it with the next liquid. In this case solenoid valves are to be arranged between the compressed air container and the respective liquid containers to make it possible to charge each liquid container with compressed air in turn.

Figure 16:
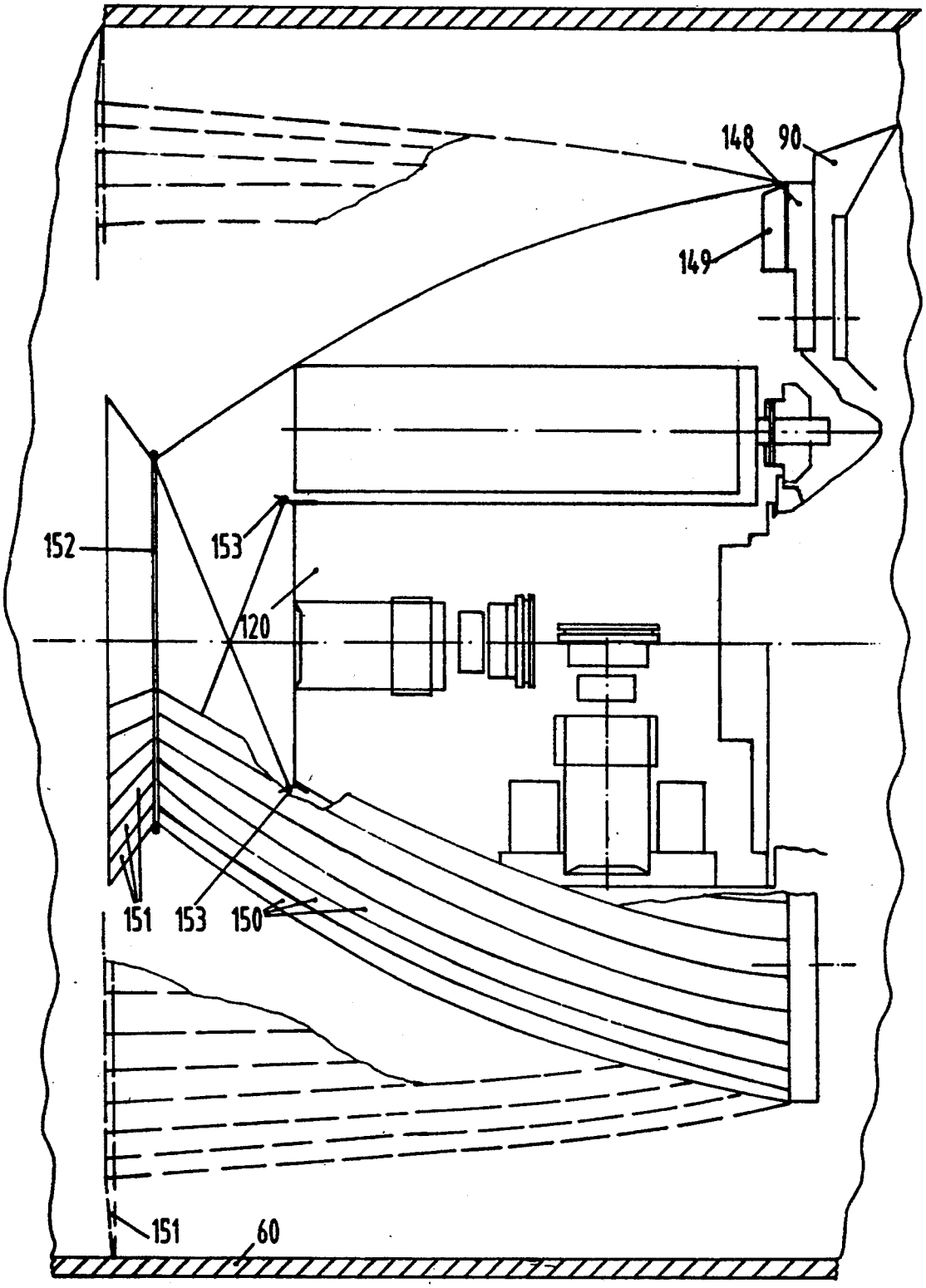
FIG. 16 shows an arrangement for retrieving objects from a pipe in a partial elevation.

The suction head 61 may furthermore be furnished with a retrieving device for removing part which have fallen into the pipe 60. As shown in FIG. 16 for this purpose instead of the operating device comprising the support levers 112 and 112' on the venting cover 90 there is a ring support 148 secured thereon. Between the ring support 148 and a ring 149 the bent or angled ends of resilient blades are gripped. Each blade 150 has an outwardly bent outer edge 151. In the position illustrated in full lines in FIG. 16 a cord 152 with a plurality of turns is so wound along the lines of bending between blades 150 and the bent outer edges 151 that it maintains the blade in a bell-like configuration clear of the bore surface. The two ends of the cord 152 are attached to pins 153, which are attached to the inspection device 120. The winding up of the cord 152 and the attachment to the pins 153 takes place on the suction head 61 clear of the pipe 60. Then the suction head 61 is moved into the pipe 60 as far as the point, at which the object to be retrieved is to be found. After this the inspection device 120 is turned in the opposite direction to the direction of winding of the cord 152. This operation causes release of the resilient blades so that they may spring out in the position depicted in FIG. 16 in broken lines. In this position the angled outer edges 151 are in engagement the pipe bore 60. By retracting suction head 61 it is consequently possible to move back a foreign body, which has fallen into the pipe, as far as the position of introduction of the suction head 61 into the pipe 60 and then to remove it here.

As will be seen from the above description the invention is not limited to the illustrated working embodiments.

I claim:

1. An appliance adapted to be run along an interior of a pipe, comprising a suction head connected to an end of a flexible hose so as to receive suction air, said suction head having suction air openings communicating with the hose, and a plurality of support wheels arranged in two planes extending perpendicularly to a direction of insertion of the appliance, said plurality of support wheels projecting past the suction head in a radial direction, said suction head having a radially outwardly movable resilient seal positioned between the suction air openings and the hose.

2. The appliance as defined in claim 1 wherein a side which is to a front in the direction of insertion the suction head bears at least one venting cover, said venting cover covering a space connected with the pipe behind the seal said venting cover is adjustable so as to form a gap between said venting cover and the pipe in front of the seal.

3. The appliance as defined in claim 2 comprising a setting spring means adapted to act on the venting cover for automatic opening of the gap and for adjustment of the size of the gap, said setting spring means being responsive to a predetermined difference in a pressure in the pipe in front of the seal and behind the seal.

4. The appliance as defined in claim 2 wherein the venting cover bears a central guide sleeve, said sleeve slidable in a bearing bushing arranged on the suction head and surrounds a bushing, fixedly connected with the bearing bushing, in order to receive the setting spring means.

5. The appliance as defined in claim 2, comprising a control member for axially moving the venting cover in a fashion independent from the setting spring means.

6. The appliance as defined in claim 5, wherein the control member comprises a two-armed lever which is pivoted on the suction head, said lever having one arm actuable by a cord, said lever having another arm actuable on the venting cover.

7. The appliance as defined in claim 2, wherein the venting cover is bearinged so that the venting cover may be turned in relation to the suction head the venting cover is provided with a drive and connection means for tools.

8. The appliance as defined in claim 7, wherein said connection means for the tools comprise at least two support levers, which are bearinged for pivoting about axes parallel to a central longitudinal axis of the suction head, each support lever being provided with a return spring, said return springs being adapted to hold support levers in a neutral position located inside an outline of the suction head.

9. The appliance as defined in claim 8, wherein the support levers are connected in a detachable fashion with the venting cover for replacement thereof.

10. The appliance as defined in claim 9, wherein the support levers carry grinding heads for processing the bore surface of the pipe.

11. The appliance as defined in claim 7, wherein the venting cover is of an annular configuration and is rotatably mounted on a central support bushing which is axially slidable in relation to the suction head.

12. The appliance as defined in claim 7, wherein on the side thereof facing the front part of the suction head the venting cover has vanes forming a drive impeller.

13. The appliance as defined in claim 7, wherein the venting cover comprises tube members extending axially for a connection of a space behind the venting cover with the pipe behind the seal.

14. The appliance as defined in claim 1, wherein said suction air openings are arranged in an outer part of the suction head.

15. The appliance as defined in claim 1, wherein the suction air openings are formed in an oblique wall part of the suction head such that a front limiting surface of the suction openings end on a smaller diameter than a rear limiting surface, said front limiting surface is to a front of the direction of insertion.

16. The appliance as defined in claim 15, wherein the rear limiting surface extends obliquely outwards in the direction of insertion.

17. The appliance as defined in claim 1, wherein the sum of cross sectional areas of the suction openings is at the most equal to a sectional area of a connection nipple.

18. The appliance as defined in claim 1, wherein the support wheels are arranged so that they may be adjusted in the radial direction.

19. The appliance as defined in claim 1, wherein the support wheels are acted upon by outwardly acting springs, said outwardly acting springs urging the support wheels against inner wall surfaces of the pipe.

20. The appliance as defined in claim 1, wherein rear support wheels of said plurality of support wheels are arranged on a bushing which is adjustable in the direction of insertion.

21. The appliance as defined in claim 1, wherein said seal is constituted by overlapping, blade-like resilient elements, which are convexly curved towards a bore surface of the pipe.

22. The appliance as defined in claim 21, wherein said elements are in the form of spring-quality sheet metal.

23. The appliance as defined in claim 1, wherein said suction head comprises a front part bearing a venting cover and a rear part bearing front support wheels, said parts being detachably connected with each other, said rear part being adapted for the detachable connection thereto of a hose connection nipple and support wheels.

24. The appliance as defined in claim 1, comprising a ring bearer of a retrieving device adapted to be mounted on the suction head, said retrieving device bearing a ring of resilient blades, said ring of resilient blades having inwardly bent outer edges adapted to engage a bore surface in an operative position thereof and are retainable in a bell-like introduction setting clear of the bore surface by a cord.

25. The appliance as defined in claim 1, further comprising a central plug connection centered on a central longitudinal axis of the suction head, said central plug connection adapted for connection of tools.

26. The appliance as defined in claim 25, wherein the plug connection comprises a coupling ring borne in a rotatable fashion in a support bushing.

27. The appliance as defined in claim 25, comprising a locating pin arranged on the coupling ring for ensuring the fitting of the plug connection in a predetermined position.

28. The appliance as defined in claim 25, wherein said plug connection adapted for attachment of an inspection device on the suction head.

29. The appliance as defined in claim 28, wherein the said inspection device is provided with a drive motor for rotation thereof in relation to the suction head.

30. The appliance as defined in claim 29, where said drive motor comprises a drive wheel adapted to roll on an outer surface of a support bushing.

31. The appliance as defined in claim 30, comprising a rib section fitting behind the drive wheel, mounted on the support bushing in order to secure the drive wheel in a draw off direction.

32. The appliance as defined in claim 28, further comprising a slip ring device provided in the suction head for electrical connection of the inspection device with a source of electrical power and with a monitor.

33. The appliance as defined in claim 29, wherein said inspection device comprises two video cameras of which one video camera is directed parallel to the center longitudinal axis of the suction head and the other video camera is directed towards an inner wall surface of the pipe.

34. The appliance as defined in claim 1, comprising a liquid application device adapted to be connected with a rotary part of the suction head, said liquid application device having at least one liquid container and a compressed air container and such liquid container accommodates a bag adapted to be filled with liquid, an outer side of the bag being able to be subjected to compressed air pressure from the compressed air container.

35. The appliance as defined in claim 34, wherein the said liquid application device is adapted to be connected with a housing of an inspection device.

36. The appliance as defined in claim 35, wherein said liquid application device including electrical connection means is able to be electrically connected with the inspection device by means of a stationary plug contact device.

37. The appliance as defined in claim 34, comprising a solenoid valve arranged between each liquid container and a spray nozzle directed towards a bore surface of the pipe.

38. The appliance as defined in claim 34, wherein each liquid container comprises a filling duct able to be shut by a check valve.

* * * * *